US005833839A

United States Patent [19]

Wittenbrink et al.

[11] Patent Number: 5,833,839

[45] Date of Patent: Nov. 10, 1998

[54] HIGH PURITY PARAFFINIC SOLVENT COMPOSITIONS, AND PROCESS FOR THEIR MANUFACTURE

[75] Inventors: Robert Jay Wittenbrink, Baton Rouge, La.; Steven Earl Silverberg, Seabrook, Tex.; Daniel Francis Ryan, Baton Rouge, La.

[73] Assignee: Exxon Research and Engineering Company, Florham Park, N.J.

[21] Appl. No.: 569,466

[22] Filed: Dec. 8, 1995

[51] Int. Cl.[6] ..... C10G 47/00; C10G 35/04

[52] U.S. Cl. ..... 208/112; 208/102; 208/136; 208/138; 585/752; 585/13

[58] Field of Search ..... 585/13, 752; 208/102, 208/27, 112, 136, 138

[56] References Cited

U.S. PATENT DOCUMENTS 2,668,866 2/1954 Good et al. ..... 208/18
4,832,819 5/1989 Hamner ..... 208/27
4,919,786 4/1990 Hamner et al. ..... 208/27

*Primary Examiner*—Walter D. Griffin
*Attorney, Agent, or Firm*—Jay Simon

[57] ABSTRACT

Discloses high purity solvent compositions constituted of n-paraffins and isoparaffins, with the isoparaffins containing predominantly methyl branches, and having an isoparaffin:n-paraffin ratio sufficient to provide superior low temperature properties and low viscosities. The solvent compositions are made by a process wherein a waxy, or long chain paraffinic feed, especially a Fischer-Tropsch wax, is reacted over a dual function catalyst to produce hydroisomerization and hydrocracking reactions at 700° F.+ conversion levels ranging from about 20 to 90 wt. % to provide a $C_5$-1050° F. crude fraction. The $C_5$-1050° F. crude fraction is then topped via atmospheric distillation to produce a low boiling fraction with an upper end point boiling between about 650° F. and 750° F. The low boiling fraction is fractionated and a narrow boiling range solvent obtained therefrom; one which can be further divided into solvent grades of various boiling ranges.

15 Claims, No Drawings

HIGH PURITY PARAFFINIC SOLVENT COMPOSITIONS, AND PROCESS FOR THEIR MANUFACTURE

1. FIELD OF THE INVENTION

This invention relates to high purity paraffinic solvent compositions, and process for the production of such compositions by the hydroisomerization and hydrocracking of long chain linear paraffins, especially Fischer-Tropsch waxes. In particular, it relates to solvent compositions characterized as mixtures of $C_8$–$C_{20}$ n-paraffins and isoparaffins, with the isoparaffins containing predominantly methyl branching and an isoparaffin:n-paraffin ratio sufficient to provide superior low temperature properties and low viscosities.

2. BACKGROUND

Paraffinic solvents provide a variety of industrial uses. For example, NORPAR solvents, several grades of which are marketed by Exxon Chemical Company, e.g., are constituted almost entirely of $C_{10}$–$C_{15}$ linear, or normal paraffins (n-paraffins). They are made by the molecular sieve extraction of kerosene via the ENSORB process. These solvents, because of their high selective solvency, low reactivity, mild odor and relatively low viscosity, are used in aluminum rolling oils, as diluent solvents in carbonless copy paper, and in spark erosion machinery. They are used successfully in pesticides, both in emulsifiable concentrates and in formulations to be applied by controlled droplet application, and can even meet certain FDA requirements for use in food-related applications. The NORPAR solvents, while having relatively low viscosity, unfortunately have relatively high pour points; properties which cannot be improved in the ENSORB process by a wider n-paraffin cut because the $C_{15}$+ n-paraffins have high melting points. Thus, the addition of $C_{15}$+ paraffins will only worsen the pour point.

Solvents constituted of mixtures of highly branched paraffins, or isoparaffins, with very low n-paraffin content, are also commercially available. For example, several grades of ISOPAR solvents, i.e., iso-paraffins or highly branched paraffins, are supplied by Exxon Chemical Company. These solvents, derived from alkylate bottoms (typically prepared by alkylation), have many good properties; e.g., high purity, low odor, good oxidation stability, low pour point, and are suitable for many food-related uses. Moreover, they possess excellent low temperature properties. Unfortunately however, the ISOPAR solvents have very high viscosities, e.g., as contrasted with the NORPAR solvents. Despite the need, a solvent which possesses substantially the desirable properties of both the NORPAR and ISOPAR solvents, but particularly the low viscosity of the NORPAR solvents and the low temperature properties of the ISOPAR solvents is not available.

3. SUMMARY OF THE INVENTION

The present invention accordingly, to meet these and other needs, relates to a high purity solvent composition comprising a mixture of paraffins having from about 8 to about 20 carbon atoms, i.e., $C_8$–$C_{20}$, preferably from about $C_{10}$–$C_{16}$, carbon atoms, in the molecule. The solvent composition has an isoparaffin:n-paraffin ratio ranging from about 0.5:1 to about 9:1, preferably from about 1:1 to about 4:1. The isoparaffins of the mixture contain greater than fifty percent, 50%, mono-methyl species, e.g., 2-methyl, 3-methyl, 4-methyl, ≧5- methyl or the like, with minimum formation of branches with substituent groups of carbon number greater than 1, i.e., ethyl, propyl, butyl or the like, based on the total weight of isoparaffins in the mixture. Preferably, the isoparaffins of the mixture contain greater than 70 percent of the mono-methyl species, based on the total weight of the isoparaffins in the mixture. The paraffinic solvent mixture boils within a range of from about 320° F. to about 650° F., and preferably within a range of from about 350° F. to about 550° F. In preparing the different solvent grades, the paraffinic solvent mixture is generally fractionated into cuts having narrow boiling ranges, i.e., 100° F., or 50° F. boiling ranges.

The properties of these solvents, e.g., viscosity, solvency and density, are similar to NORPAR solvents of similar volatility but have significantly lower pour points. These solvents also have significantly lower viscosities than ISOPAR solvents of similar volatility. In fact, these solvents combine many of the most desirable properties found in the NORPAR and ISOPAR solvents. In particular however, the solvents of this invention have the good low temperature properties of ISOPAR solvents and the low viscosities of the NORPAR solvents; and yet maintain most of the other important properties of these solvents.

The solvents of this invention are produced by the hydrocracking and hydroisomerization of $C_5$+ paraffinic, or waxy hydrocarbon feeds, especially Fischer-Tropsch waxes, or reaction products, at least a fraction of which boils above 700° F., i.e., at 700° F.+. The waxy feed is first contacted, with hydrogen, over a dual functional catalyst to produce hydroisomerization and hydrocracking reactions sufficient to convert at least about 20 percent to about 90 percent, preferably from about 30 percent to about 80 percent, on a once through basis based on the weight of the 700° F.+ feed component, or 700° F.− feed, to 700° F.− materials, and produce a liquid product boiling at from about 74° F. to about 1050° F., i.e., a $C_5$-1050° F. liquid product, or crude fraction. The $C_5$-1050° F. crude fraction is topped via atmospheric distillation to produce two fractions, (i) a low boiling fraction having an initial boiling point ranging between about 74° F. and about 100° F., and an upper end boiling point ranging between about 650° F. and about 750° F., preferably between about 650° F. and 700° F., and (ii) a high boiling fraction having an initial boiling point ranging between about 650° F. and about 750° F., preferably from about 650° F. and 700° F., and an upper end boiling point of about 1050° F., or higher, i.e., 1050° F.+. This high boiling fraction typically constitutes a lube fraction. The solvent of this invention is recovered from the low boiling fraction, or fraction boiling between about $C_5$ and about 650° F. to 750° F. The solvent on recovery from the low boiling fraction is fractionated into several narrow boiling range grades of solvent, preferably solvents boiling over a 100° F., and preferably a 50° F. range.

4. DETAILED DESCRIPTION

The feed materials that are hydroisomerized and hydrocracked to produce the solvents of this invention are waxy feeds, i.e., $C_5$+, preferably boiling above about 350° F. (117° C.), more preferably above about 550° F. (288° C.), and are preferably obtained from a Fischer-Tropsch process which produces substantially normal paraffins, or may be obtained from slack waxes. Slack waxes are the by-products of dewaxing operations where a diluent such as propane or a ketone (e.g., methylethyl ketone, methyl isobutyl ketone) or other diluent is employed to promote wax crystal growth, the wax being removed from the lubricating oil base stock by filtration or other suitable means. The slack waxes are generally paraffinic in nature, boil above about 600° F. (316°

C.), preferably in the range of 600° F. (316° C.) to about 1050° F. (566° C.), and may contain from about 1 to about 35 wt. % oil. Waxes with low oil contents, e.g., 5–20 wt. % are preferred; however, waxy distillates or raffinates containing 5–45% wax may also be used as feeds. Slack waxes are usually freed of polynuclear aromatics and hetero-atom compounds by techniques known in the art; e.g., mild hydrotreating as described in U.S. Pat. No. 4,900,707, which also reduces sulfur and nitrogen levels preferably to less than 5 ppm and less than 2 ppm, respectively. Fischer-Tropsch waxes are preferred feed materials, having negligible amounts of aromatics, sulfur and nitrogen compounds. The Fischer-Tropsch liquid, and wax, is characterized as the product of a Fischer-Tropsch process wherein a synthetic gas, or mixture of hydrogen and carbon monoxide, is processed at elevated temperature over a supported catalyst comprised of a Group VIII metal, or metals, of the Periodic Table of The Elements (Sargent-Welch Scientific Company, Copyright 1968), e.g., cobalt, ruthenium, iron, etc. The Fischer-Tropsch liquid contains $C_5$+, preferably $C_{10}$+, more preferably $C_{20}$+ paraffins. A distillation showing the fractional make up (±10 wt. % for each fraction) of a typical Fischer-Tropsch process feedstock is as follows:

| Boiling Temperature Range | Wt. % of Fraction |
|---|---|
| IBP–320° F. | 13 |
| 320–500° F. | 23 |
| 500–700° F. | 19 |
| 700–1050° F. | 34 |
| 1050° F.+ | 11 |
| | 100 |

The wax feed is contacted, with hydrogen, at hydrocracking/hydroisomerization conditions over a bifunctional catalyst, or catalyst containing a metal, or metals, hydrogenation component and an acidic oxide support component active in producing both hydrocracking and hydroisomerzation reactions. Preferably, a fixed bed of the catalyst is contacted with the feed at conditions which convert about 20 to 90 wt. %, preferably about 30 to 80 wt. % of the 700° F.+ feed components (or a 700° F.+ feed) to a low boiling fraction having an initial boiling point of about $C_5$ (about 74° F. to about 100° F.) and an end boiling point ranging between about 650° F. and about 750° F., preferably between about 650° F. and about 700° F., and a higher boiling fraction having an initial boiling point corresponding to the upper end boiling point of the low boiling fraction and a higher end boiling point of 1050° F., or greater. In general, the hydrocracking/hydroisomerization reaction is conducted by contacting the waxy feed over the catalyst at a controlled combination of conditions which produce these levels of conversion, e.g., by selection of temperatures ranging from about 400° F. to about 850° F., preferably from about 500° F. to about 700° F., pressures ranging generally from about 100 pounds per square inch gauge (psig) to about 1500 psig, preferably from about 300 psig to about 1000 psig, hydrogen treat gas rates ranging from about 1000 SCFB to about 10,000 SCFB, preferably from about 2000 SCFB to about 5000 SCFB, and space velocities ranging generally from about 0.5 LHSV to about 10 LHSV, preferably from about 0.5 LHSV to about 2 LHSV.

The active metal component of the catalyst is preferably a Group VIII metal, or metals, of the Periodic Table Of The Elements (Sargent-Welch Scientific Company Copyright 1968) in amount sufficient to be catalytically active for hydrocracking and hydroisomerization of the waxy feed. The catalyst may also contain, in addition to the Group VIII metal, or metals, a Group IB and/or a Group VIB metal, or metals, of the Periodic Table. Generally, metal concentrations range from about 0.05 percent to about 20 percent, based on the total weight of the catalyst (wt. %), preferably from about 0.1 wt. percent to about 10 wt. percent. Exemplary of such metals are such non-noble Group VIII metals as nickel and cobalt, or mixtures of these metals with each other or with other metals, such as copper, a Group IB metal, or molybdenum, a Group VIB metal. Palladium and platinum are exemplary of suitable Group VIII noble metals. The metal, or metals, is incorporated with the support component of the catalyst by known methods, e.g., by impregnation of the support with a solution of a suitable salt or acid of the metal, or metals, drying and calcination.

The catalyst support is constituted of metal oxide, or metal oxides, components at least one component of which is an acidic oxide active in producing olefin cracking and hydroisomerization reactions. Exemplary oxides include silica, silica-alumina, clays, e.g., pillared clays, magnesia, titania, zirconia, halides, e.g., chlorided alumina, and the like. The catalyst support is preferably constituted of silica and alumina, a particularly preferred support being constituted of up to about 35 wt. % silica, preferably from about 2 wt. % to about 35 wt. % silica, and having the following pore-structural characteristics:

| Pore Radius, Å | Pore Volume |
|---|---|
| 0–300 | >0.03 ml/g |
| 100–75,000 | <0.35 ml/g |
| 0–30 | <25% of the volume of the pores with 0–300 Å radius |
| 100–300 | <40% of the volume of the pores with 0–300 Å radius |

The base silica and alumina materials can be, e.g., soluble silica containing compounds such as alkali metal silicates (preferably where $Na_2O:SiO_2$=1:2 to 1:4), tetraalkoxy silane, orthosilic acid ester, etc.; sulfates, nitrates, or chlorides of aluminum alkali metal aluminates; or inorganic or organic salts of alkoxides or the like. When precipitating the hydrates of silica or alumina from a solution of such starting materials, a suitable acid or base is added and the pH is set within a range of about 6.0 to 11.0. Precipitation and aging are carried out, with heating, by adding an acid or base under reflux to prevent evaporation of the treating liquid and change of pH. The remainder of the support producing process is the same as those commonly employed, including filtering, drying and calcination of the support material. The support may also contain small amounts, e.g., 1–30 wt. %, of materials such as magnesia, titania, zirconia, hafnia, or the like.

Support materials and their preparation are described more fully in U.S. Pat. No. 3,843,509 incorporated herein by reference. The support materials generally have a surface area ranging from about 180–400 $m^2/g$, preferably 230–375 $m^2/g$, a pore volume generally of about 0.3 to 1.0 ml/g, preferably about 0.5 to 0.95 ml/g, bulk density of generally about 0.5–1.0 g/ml, and a side crushing strength of about 0.8 to 3.5 kg/mm.

The hydrocracking/hydroisomerization reaction is conducted in one or a plurality of reactors connected in series, generally from about 1 to about 5 reactors; but preferably the reaction is conducted in a single reactor. The waxy hydrocarbon feed, e.g., Fischer-Tropsch wax, preferably one boiling above about 350° F. (177° C.), more preferably above about 550° F. (288° C.), is fed, with hydrogen, into the reactor, a first reactor of the series, to contact a fixed bed of the catalyst at hydrocracking/hydroisomerization reaction conditions to hydrocrack, hydroisomerize and convert at least a portion of the waxy feed to products suitable as solvents for the practice of this invention.

The following examples are illustrative of the more salient features of this invention. All parts, and percentages, are given in terms of weight unless otherwise specified.

EXAMPLES 1–3

A mixture of hydrogen and carbon monoxide synthesis gas ($H_2$:CO 2.11–2.16) was converted to heavy paraffins in a slurry Fischer-Tropsch reactor. A titania supported cobalt rhenium catalyst was utilized for the Fischer-Tropsch reaction. The reaction was conducted at 422°–428° F., 287–289 psig, and the feed was introduced at a linear velocity of 12 to 17.5 cm/sec. The alpha of the Fischer-Tropsch synthesis step was 0.92. The paraffinic Fischer-Tropsch product was isolated in three nominally different boiling streams; separated by utilizing a rough flash. The three boiling fractions which were obtained were: 1) a $C_5$-500° F. boiling fraction, i.e., F-T cold separator liquids; 2) a 500°–700° F. boiling fraction, i.e., F-T hot separator liquids; and 3) a 700° F.+ boiling fraction, i.e., an F-T reactor wax.

The 700° F.+ boiling fraction, or reactor wax, was then hydroisomerized and hydrocracked over a Pd/silica-alumina catalyst (0.50 wt.% Pd; 38 wt. % $Al_2O_3$;62 wt. % $SiO_2$), at process conditions providing a 39.4 wt. % conversion of the 700° F.+ materials to 700° F.− materials. The operating conditions, wt. % yield, and product distributions obtained in the run are as described in Table 1.

TABLE 1

| Operating Conditions | |
|---|---|
| Temp., °F. | 638 |
| LHSV, v/v/h | 1.2 |
| PSIG | 711 |
| $H_2$ Treat rate, SCF/B | 2100 |
| Yields wt. % | |
| $C_1$–$C_4$ | 0.97 |
| $C_5$ –320° F. | 10.27 |
| 320–500° F. | 14.91 |
| 500–700° F. | 29.99 |
| 700° F.+ | 43.86 |
| Total | 100.00 |
| 700° F.+ Conversion, wt. % | 39.4 |
| 15/5 Distillation Yields, wt. % | |
| IBP–650° F. | 50.76 |
| 650° F.+ | 49.24 |

The total liquid product from this run was first topped at 650° F. in an atmospheric 15/5 distillation. The low boiling, or 650° F.−fraction was then fractionated into ten (10) LV % Cuts in a 15/5 distillation, 30 LV (Liquid Volume) % of which constituted the solvent of this invention. The physical properties of three of these cuts, representing the 30–40 LV %, the 40–50 LV %, and 50–60 LV % cuts, respectively, are listed in Table 2 as Sample Nos. 1, 2 and 3, respectively.

TABLE 2

| Sample No. | 1 | 2 | 3 |
|---|---|---|---|
| Flash, °F. | 147 | 228 | 262 |
| GCD, ° F. | | | |
| 5% | 369 | 430 | 474 |
| 50% | 427 | 474 | 517 |
| 95% | 471 | 510 | 547 |
| SPG @ 60° F. | 0.7594 | 0.7706 | 0.7777 |
| Vis @ 25° C., cSt | 1.82 | 2.67 | 3.52 |
| KB Value | 25 | 23 | 21 |
| Aniline Pt., °F. | 185 | 194 | 202 |
| Pour Pt., °F. | −70 | −40 | −20 |
| Surf. Tens. (dynes/cm) | 28 | 29 | 29 |
| Color (Saybolt) | +30 | +30 | +30 |

A list of the normal paraffin content by G.C., and branching density by NMR, % carbon, for each of the three cuts, representative of three solvent grades, is given in Tables 3 and 4, respectively.

TABLE 3

NORMAL PARAFFIN CONTENT BY GC

| Sample No. | 1 | 2 | 3 |
|---|---|---|---|
| Normal Paraffin Content | | | |
| $C_4$ | — | — | — |
| $C_5$ | — | — | — |
| $C_6$ | — | — | — |
| $C_7$ | — | — | — |
| $C_8$ | 0.009 | — | — |
| $C_9$ | 0.070 | — | — |
| $C_{10}$ | 0.669 | 0.001 | — |
| $C_{11}$ | 3.086 | 0.025 | — |
| $C_{12}$ | 6.148 | 0.632 | — |
| $C_{13}$ | 3.040 | 5.217 | 0.217 |
| $C_{14}$ | 0.158 | 7.094 | 4.712 |
| $C_{15}$ | — | 0.971 | 10.677 |
| $C_{16}$ | — | 0.017 | 1.943 |
| $C_{17}$ | — | | 0.040 |
| Total | 13.180 | 13.957 | 17.589 |

TABLE 4

BRANCHING DENSITY BY NMR, % CARBON

| Sample No. | Methyls | Ethyls | Propyls and Butyls | 2-Methyl | 3-Methyl | 4-Methyl | 5+-Methyl |
|---|---|---|---|---|---|---|---|
| 1 | 8.4 | 1.5 | NM | 1.7 | 1.9 | 1.5 | NM |
| 2 | 7.7 | 1.5 | NM | 1.4 | 1.6 | 1.3 | 1.9 |
| 3 | 7.5 | 1.6 | NM | 1.3 | 1.4 | 1.2 | 1.9 |

NM = Not Measured

Comparison of the physical properties of the solvents of this invention, by grade, shows that they compare favorably with, and in some respects are superior to NORPAR and ISOPAR solvents. The solvents of this invention, albeit structurally different from the ISOPAR solvents which are highly branched, with low paraffin content, like the ISOPARs have low odor, good selective solvency, high oxidative stability, low electrical conductivity, low skin irritation and suitability for many food-related uses. Unlike the ISOPAR solvents however, the solvents of this invention have low viscosities. Moreover, though structurally different from the NORPAR solvents which are essentially all n-paraffins, the solvents of this invention like the NORPAR solvents have low reactivity, selective solvency, moderate volatility, relatively low viscosity and mild odor. Unlike the NORPAR solvents however, the solvents of this invention have low pour points. The solvents of this invention thus have most of the desirable features of both the NORPAR and ISOPAR solvents, but are superior to the NORPAR solvents in that they have pour points ranging from about −20° F. to about −70° F., while the pour points of the NORPAR solvents range from about 45° F. to about −6° F.; and are superior to the ISOPAR solvents in that they have viscosities at 25° C. ranging from about 1.82 cSt to about 3.52 cSt, while the viscosities of the ISOPAR solvents range from about 2.09 cSt to about 9.17 cSt.

The unique properties of the solvents of this invention, provide advantages in a variety of current solvent and fluids applications, e.g., aluminum rolling, secondary PVC plasticizers and inks. In addition, mild hydrotreatment of these solvents produces a material which readily passes the "readily carbonizable substance test" (i.e., hot acid test) which makes the solvents applicable to a wide variety of medicinal and food applications.

It is apparent that various modifications and changes can be made without departing the spirit and scope of this invention.

Having described the invention, what is claimed is:

1. A process for the production of a solvent composition characterized as a mixture of paraffins having superior low temperature properties and low viscosities which comprises contacting a $C_5$+ paraffinic feed at least a portion of which boils at 700° F.+, with hydrogen, over a dual functional catalyst to produce hydroisomerization and hydrocracking reactions at 700° F.+ conversion levels ranging from about 20 percent to about 90 percent on a once through basis based on the weight of the 700° F.+ feed component converted to 700° F.− materials and produce a crude fraction boiling between about $C_5$ and 1050° F., topping said crude fraction to produce a low boiling fraction having an upper end boiling point between about 650° F. and about 750° F., and recovering from said low boiling fraction a solvent composition which is constituted of a mixture of isoparaffins and n-paraffins of carbon number ranging from about $C_8$ to about $C_{20}$, has a molar ratio of isoparaffins:n-paraffins ranging from about 0.5:1 to about 9:1, the isoparaffins of the mixture contain greater than 50 percent of mono-methyl species, based on the total weight of the isoparaffins of the mixture, and the composition has pour points ranging from about −20° F. to about −70° F., and viscosities at 25° C. ranging from about 1.82 cSt to about 3.52 cSt.

2. The process of claim 1 wherein the solvent composition that is recovered is characterized as a mixture of paraffins which has a carbon number ranging from about $C_{10}$ to about $C_{16}$.

3. The process of claim 1 wherein the solvent composition that is recovered is characterized as a mixture of paraffins in which the isoparaffins in the mixture contain greater than 70 percent of the mono-methyl species.

4. The process of claim 1 wherein the solvent composition that is recovered is characterized as a mixture of paraffins which boils at a temperature ranging from about 320° F. to about 650° F.

5. The process of claim 1 wherein the solvent mixture boils within a range of from about 350° F. to about 550° F.

6. The process of claim 5 wherein the mixture is comprised of a mixture of paraffins of carbon number ranging from about $C_{10}$ to about $C_{16}$.

7. The process of claim 1 wherein the solvent mixture is of carbon number ranging from about $C_{10}$–$C_{16}$, the isoparaffins in the mixture contain greater than 70 percent of the mono-methyl species, and boils within a range of from about 350° F. to about 550° F.

8. The process of claim 1 wherein the $C_5$+ paraffinic feed is a Fischer-Tropsch wax.

9. The process of claim 1 wherein the catalyst is comprised of a Group VIII metal, or metals, supported on a particulate refractory inorganic oxide carrier.

10. The process of claim 9 wherein the catalyst is comprised of a Group IB or Group VIB metal, or metals, or both a Group IB and Group VIB metal, or metals, in addition to the Group VIII metal, or metals.

11. The process of claim 10 wherein the concentration of the metal, or metals, ranges from about 0.1 percent to about 20 percent, based on the total weight of the catalyst, the Group IB metal is copper, the Group VIB metal is molybdenum, and the Group VIII metal is palladium, platinum, nickel, or cobalt.

12. The process of claim 1 wherein the solvent composition is recovered from the low boiling fraction by distillation.

13. The process of claim 1 wherein the molar ratio of isoparaffins:n-paraffins in the mixture ranges from about 1:1 to about 4:1.

14. The process of claim 1 wherein from about 30 percent to about 80 percent of the 700° F.+ component of the $C_5$+ paraffinic feed is converted to 700° F.−materials in conducting the hydroisomerization and hydrocracking reactions.

15. The process of claim 1 wherein the $C_5$+ feed is obtained from a Fischer-Tropsch process.

* * * * *